US005193799A

United States Patent [19]

Scheufler et al.

[11] Patent Number: 5,193,799

[45] Date of Patent: Mar. 16, 1993

[54] APPARATUS FOR DEPOSITING COPY SHEETS IN A STACKING BIN

[75] Inventors: Gert Scheufler, Winnenden; Gert Haertwich, Esslingen; Dietmar Blaettner, Schwaikheim, all of Fed. Rep. of Germany

[73] Assignee: Eastman Kodak Company, Rochester, N.Y.

[21] Appl. No.: 799,227

[22] Filed: Nov. 27, 1991

[30] Foreign Application Priority Data

Jan. 18, 1991 [DE] Fed. Rep. of Germany ..... 4101436

[51] Int. Cl.[5] ..... B65H 31/04; B65H 31/20

[52] U.S. Cl. ..... 271/213; 271/223

[58] Field of Search ..... 271/184, 213, 214, 220, 271/223, 224

[56] References Cited

U.S. PATENT DOCUMENTS

| | | | |
|---|---|---|---|
| 4,405,125 | 9/1983 | Kulpa et al. | 271/224 X |
| 4,930,765 | 6/1990 | Russel et al. | 271/223 X |
| 5,087,026 | 2/1992 | Wyer | 271/223 X |
| 5,141,220 | 8/1992 | Ettischer | 271/223 |

FOREIGN PATENT DOCUMENTS

| | | | |
|---|---|---|---|
| 52142 | 3/1983 | Japan | 271/223 |
| 143168 | 6/1988 | Japan | 271/220 |

*Primary Examiner*—Robert P. Olszewski
*Assistant Examiner*—Boris Milef
*Attorney, Agent, or Firm*—Lawrence P. Kessler

[57] ABSTRACT

An apparatus for facilitating depositing copy sheets in a collecting bin (6, 15) which, in the sheet entry direction, is arranged in a downwardly inclined position and is provided with a stop member (14) associated with the leading portion of the sheets. The trailing portion of the sheets is associated with guide element (19, 30) directing the incoming sheets onto the top of the sheet stack already deposited. Above the sheet stack (23, 23*a*) rollers (22, 26) are arranged which are driven in sheet entry direction and associated with the trailing portion of the sheet and whose surface area facing the sheet stack (23, 23*a*) lines beneath the entry plane of the sheets defined by the guide elements (19, 30) to the extent that also in the case of curled sheets it confines the top of the sheet stack (23, 23*a*) in a position beneath the sheet entry plane keeping the feed path open. The rollers include stationary rollers (22) associated with a first guide element (19) and rollers (26), pivoted parallel to rollers (22), associated with a second guide element (30) and in the pivotal path of the first guide element (19). The guide elements (19, 30) can be selectively moved to a position in which they extend upward beyond the sheet stack (23, 23*a*) so as to form a ramp.

4 Claims, 4 Drawing Sheets

APPARATUS FOR DEPOSITING COPY SHEETS IN A STACKING BIN

BACKGROUND OF THE INVENTION

This invention is directed to apparatus for facilitating depositing of sheets in a stacking bin such that a larger number of sheet formats can be reliably deposited and unobstructedly aligned.

Copending U.S. patent application Ser. No. 07/615,115, filed Nov. 19, 1990 relates to an apparatus for depositing sheets, particularly copy sheets produced by a copier, which are individually fed into a bin and collected there in stacked relation. The bin has a depositing surface and a stop means for registering the leading edge of the incoming sheets and at least one guide element arranged opposite said stop means and directing the sheet fed to the bin onto those already deposited. A device, located above the sheet stack to be formed and within the collecting bin, includes at least one stationary roller associated with the trailing portion of the sheet stack facing the guide element and is driven in sheet entry direction. The surface facing the sheet stack lies beneath the entry plane of the sheets determined by the guide element to the extent that it limits the top and trailing portion, respectively, of the sheet stack in a recessed position beneath the sheet entry plane, keeping the feed path open.

Utilizing the apparatus according to the aforementioned U.S. patent application, it is possible to confine several sheet formats within a limited range of sheet formats in a recessed position, keeping the feed path open. This is effected by means of a guide element and a roller or a series of rollers provided in the trailing portion of the deposited sheets. Depending on the setting of the sheet format to be processed, it is also possible in the above apparatus to move the rollers from an inoperative position to an operative position associated with the trailing portion of the sheet stack to be formed.

In an apparatus of the above-described type, a number of very different sheet formats are to be processed, e.g., long sheets entering in longitudinal direction (DIN A3), short sheets (DIN A5) or sheet entering (transversely) with their longer edge (DIN A4) as well as further sheet formats entering longitudinally or transversely. However, when the apparatus is set to the smallest sheet format (DIN A5) or when sheet formats enter transversely, the sheets drop into the collecting bin over a very long path without being appropriately guided so that they may take a canted position that cannot be corrected prior to the arrival of the following sheet.

SUMMARY OF THE INVENTION

This invention is directed to apparatus for facilitating reliable depositing of sheets of a large number of formats in a stacking bin. In such apparatus, parallel to a stationary roller, at least one pivotable second roller of identical diameter is arranged in spaced relation thereto. Such second roller is positioned upstream of the stationary roller, as seen in feeding direction. The stationary roller is associated with a first guide element, and the pivotable roller is associated with a second guide element. The guide elements can be selectively pivoted from the plane of the depositing surface to a position in which they extend upward beyond the sheet stack so as to form a ramp. The pivotable roller is arranged on at least one support which can be pivoted about the shaft of the stationary roller and in the path of movement of said first guide element. The pivotable roller is jointly driven with the stationary roller in the same direction and at the same circumferential speed. Accordingly, the support contacts a stationary stop means under the action of gravity such that the spacing between the pivotable roller and the depositing surface of the collecting bin is limited, but the roller of the second guide element can be raised. The roller contacting the upwardly pivoted guide element then advantageously act as a transport roller which temporarily guides incoming sheets of a smaller format or transversely entering sheets so that they do not take an undesired canted position or are deposited in an extremely offset manner.

The pivotable roller, according to the invention, is used either for limiting the stack height or in connection with the first guide element as a transport roller. The limitation of the sheet stack height permits the sheet entry plane to be arranged above the sheet stack at a relatively small distance to the depositing surface of the collecting bin and to be defined by the ramp-like guide element so that the collecting bin in its entirety can be designed low in height and arranged in a space-saving manner.

Further features and advantages can be taken from the description of an embodiment of the invention shown in the drawings and from the subclaims.

BRIEF DESCRIPTION OF THE DRAWINGS

Further features and advantages can be inferred from the description of embodiments of the invention illustrated in the drawings and from the subclaims. The drawings show:

DESCRIPTION OF THE PREFERRED EMBODIMENT

Figure 1:
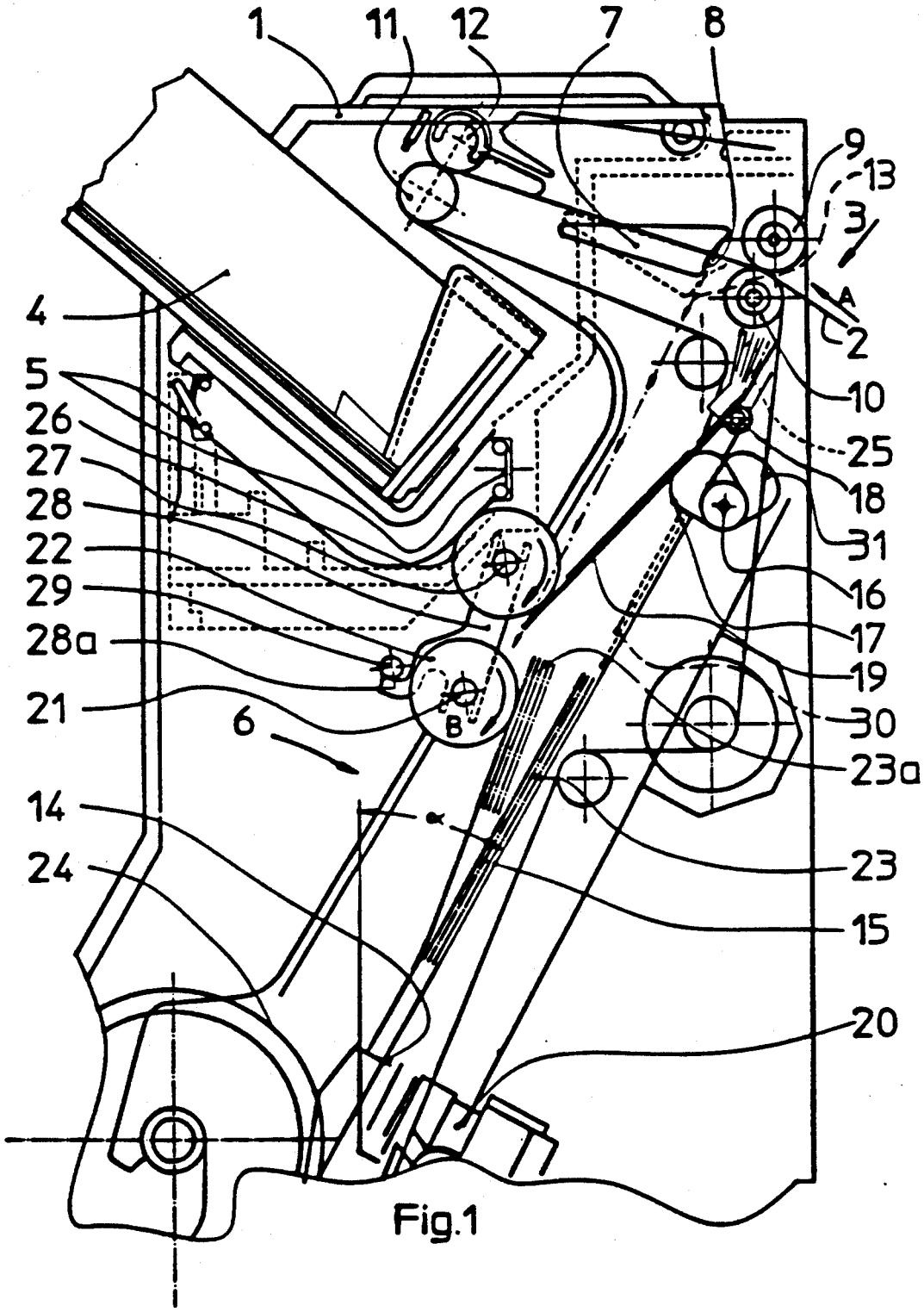
FIG. 1 is a side elevational view, partly in cross-section, of the apparatus according to this invention.

The invention will be described with respect to a finisher in which copy sheet can be stacked either individually or in sets in an offset manner, or in which the sets of copy sheet are stapled and the stapled copy sets are stacked.

Referring to the accompanying drawings, the finisher according to the invention is arranged in a housing 1 which, with its side featuring an entry section 3, is connected to the output side of a copier (not illustrated) from which individual copy sheets (in the following simply called sheets) are successively fed to the entry section (direction of arrow "A"). In housing 1 an upper bin 4 is arranged which is used for collecting loosely stacked, non-stapled sheets. In order to deposit the sheets in sets in an offset manner, the upper bin 4 is designed for movement on sliding guides 5 transversely to the sheet entry direction. Moreover, housing 1 includes a collecting bin 6 which is used for collecting sheets to be stapled in sets. In a further bin (not illustrated), the finished sets of sheets are deposited.

Collecting bin 6 is arranged at an angle of less than 45 degrees in a downwardly inclined position in the sheet entry direction, permitting the sheet to drop into the bin 6 by gravity. Selection of the desired paper path either to the upper bin 4 or to the collecting bin 6 is effected by means of a diverter 8 that can be pivoted about pin 7. When diverter 8 is in its dash-dotted position, the sheets are fed to the upper bin 4 by means of transport rollers 9, 10 and 11, 12 on a substantially rectilinear path and deposited in the bin or stacked therein in sets in an offset manner.

If stapled sets of copies are to be made, diverter 8 is moved to the position shown in solid lines in the drawing. The sheets entering in the direction of arrow "A" are then engaged by the transport rollers 9, 10 arranged in the entry section 3 and guided downward by a diverter 8 along the paper path indicated in dash-dotted lines. Having left the transport rollers 9, 10, the sheets drop into the collecting bin 6 by gravity where they are collected in superposed position on a depositing surface 15 while abutting a stop member 14 with their leading edges. In the area of stop member 14, a known stapler 20 is arranged (not illustrated). Stop member 14 is movable so as to permit a stapled set of sheets 23 to slide further down for removal.

Bin 6 is designed for selectively collecting sheets of a plurality of sheet formats of which the handling of three formats will be described, i.e., a long, a medium and a short one. In the copier, sheet supply magazines are provided (not illustrated) in each of which sheets of identical format, e.g., DIN A4, can be stored either longitudinally or transversely to the transport direction. Depending on the mode preselected on the copier, the sheets move into the collecting bin 6 oriented either longitudinally or transversely to the transport direction. This permits one and the same stapling device to staple the sheet stacks either at their longer or shorter edge. When in the following description a short sheet format is described, it may be either a DIN A5 format entering in longitudinal direction or a transversely entering DIN A4 format.

The mode represented in FIG. 1 permit deposition of a short sheet format. All sheet formats are collected abutting the same stop member 14 with their leading edges associated with the stapler 20. As far as the trailing edges of the depositing sheets are concerned, care must be taken that they do not obstruct the following sheets to be deposited. For this purpose, guide elements 19 and 30 are provided which are pivotable about a common pin 18 and can be pivoted out of the plane of the depositing surface 15 of collecting bin 6. Guide element 30 contacts guide element 19. Guide elements 19 and 30 are engaged by cams 17 and 31, respectively, which are arranged for rotation about a pin 16, the cam 31 extending through a cutout in guide element 19 and engaging guide element 30. Cams 17, 31 are actuated by known control means (not illustrated) in response to the preselected format and/or stapling position. The ramp-like guide elements 19 and 30 (see FIGS. 1 and 2) direct the incoming sheets over the end face of the accumulating sheet stack 23, 23*a* onto the top of the stack.

During the copying process, the sheets are influenced by heat, pressure, static charge and the transport means. As a result of such influence, the sheets are subject to curl, affecting deposition such that the trailing portion of the stack facing the incoming sheets turns up so as to exceed the normal height of the stack resulting from the number of sheets deposited. In the case of long sheets, due to their increased weight, this curl is less critical than in the case of short sheets. The curl of the deposited sheet, which remains particularly distinct with short sheets, leads to the fact that the stack portion facing the incoming sheets is turned up so as to obstruct entry of the following sheets.

As is apparent from the drawing, the depositing surface 15 of collecting bin 6 is arranged at an angle of less than 45°. Due to such strongly inclined position of bin 6, 15, the influence of the paper weight on the planeness of the sheets is further reduced so that a strong sheet curling may lead to an uncontrolled stack height in the sheet entry area. A steeper arrangement of the guide element 19 could result in such a height of paper entry that the incoming sheet do not hit the bent-up trailing stack portion. This would, however, entail the disadvantage that the incoming sheets would be deflected from their intended path of movement to the extent that they are not directed toward the sheet stack but away therefrom, so that they would not abut against stop member 14. Moreover, the structural height of collecting bin 6 would substantially increase by such measures so that the advantageous spatial utilization achieved by the inclined arrangement of bin 6 would partly get lost again.

In order to both guarantee functional reliability when depositing comparatively strongly curled sheet and prevent uncontrolled dropping down of small-sized sheets, according to the invention a plurality of rollers 22, 26, rotatable about stationary shaft 21, 27, are arranged near the trailing portion of the sheet stack 23, 23*a* to be formed. The rollers 22, jointly driven in the direction of arrow "B", are arranged in spaced relation to the depositing surface 15 of bin 6 such that, with regard to the guide elements 19 and 30, the height of the bent-up portion 23*a* of sheet stack 23 is confined to a recessed position. Accordingly, incoming sheets cannot hit the trailing edges of sheet already deposited but are always reliably deposited on top of the stack 23, 23*a*. A sheet entering the collecting bin 6 by the influence of gravity thus slides over the guide elements 19 and 30, is directed between roller 22, 26 and the top stack of 23, and then drops down to hit stop member 14.

As long as only a few sheets have been deposited on surface 15, the curling of the sheets, which also largely depends on the type of paper (thin/thick), will not cause the sheets to contact rollers 22 and 26. Depending on external influence and the type of paper, this situation may continue until a complete stack of sheet is formed. In this case, the rollers 22 and 26 act merely as guide rollers which do not hinder the depositing procedure because they rotate in a direction corresponding to the feed direction of the sheet (direction of arrow "B") and at a speed corresponding to the entering speed of the sheets.

Figure 4:
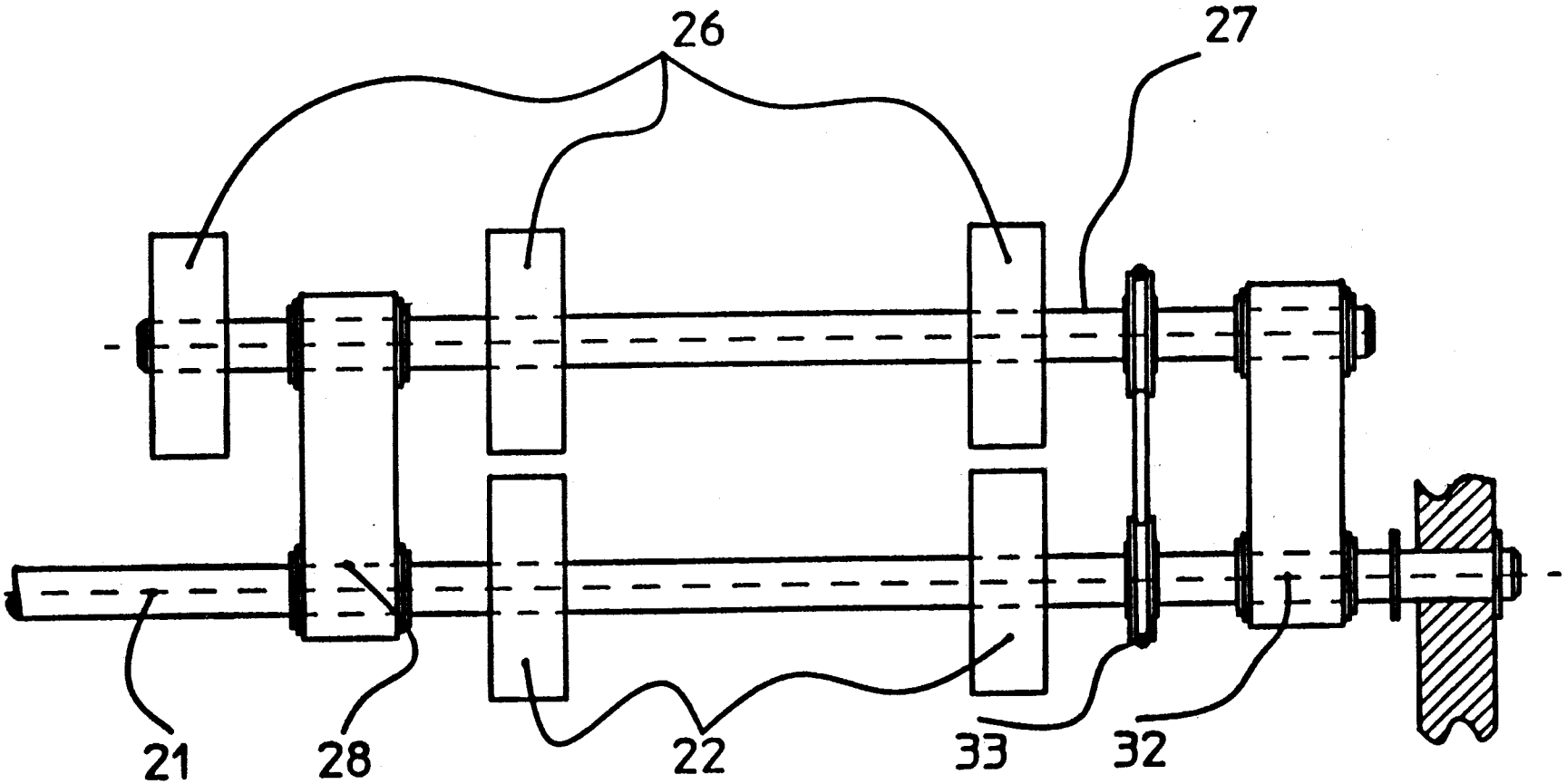
FIG. 4 is a top plan view of a part of the apparatus according to FIGS. 1-3 in a slightly enlarged representation.

In order to prevent the freely dropping sheet from taking an undesired canted position when the copier is set to "short format" (see FIG. 1), they are temporarily guided by rollers 26, which are now described in detail. Support 28, 32, carrying the rollers 26 fixed on shaft 27, are pivotally mounted on shaft 21. Shaft 27, with its rollers 26, is driven by a traction drive 33 (see FIG. 4) engaging with the motor-driven shaft 21. Rollers 22 and 26 have identical diameters. The 1–3) and by means of which the supports abut stationary stop means 29 under the action of gravity. Rollers 26 extend into the pivotal path of the longer guide element 29 such that, during upward pivotal movement, it raises the complete roller arrangement 26, 27, 28, 32, pivoting in counter-clockwise direction, to the position shown in FIG. 1. This causes the rollers 26, also rotating in the direction of arrow "B", to rest on guide element 19 under the action of gravity and act a transport rollers. Arrangement and action of rollers 26 affect the dropping sheets to be positively guided at an early stage already so that they cannot take an undesired canted position or are deposited in an extremely offset manner. As soon as the sheets have left the rollers 26, they drop down as far as stop means 14 and can be registered in the usual way.

If, however, due to the curling of the sheets, the growing stack of sheets tends to fan out excessively, the bent-up portion 23a of the stack 23 contacts the rollers 22 which prevent the stack 23, 23a from further growth in this area and thus guarantee continued reliable sheet entry. When stack 23, 23a contacts the rollers 22, they also act as transport rollers for the incoming sheet and advance it toward stop member 14 but do not obstruct the registering of the sheets.

Figure 2:
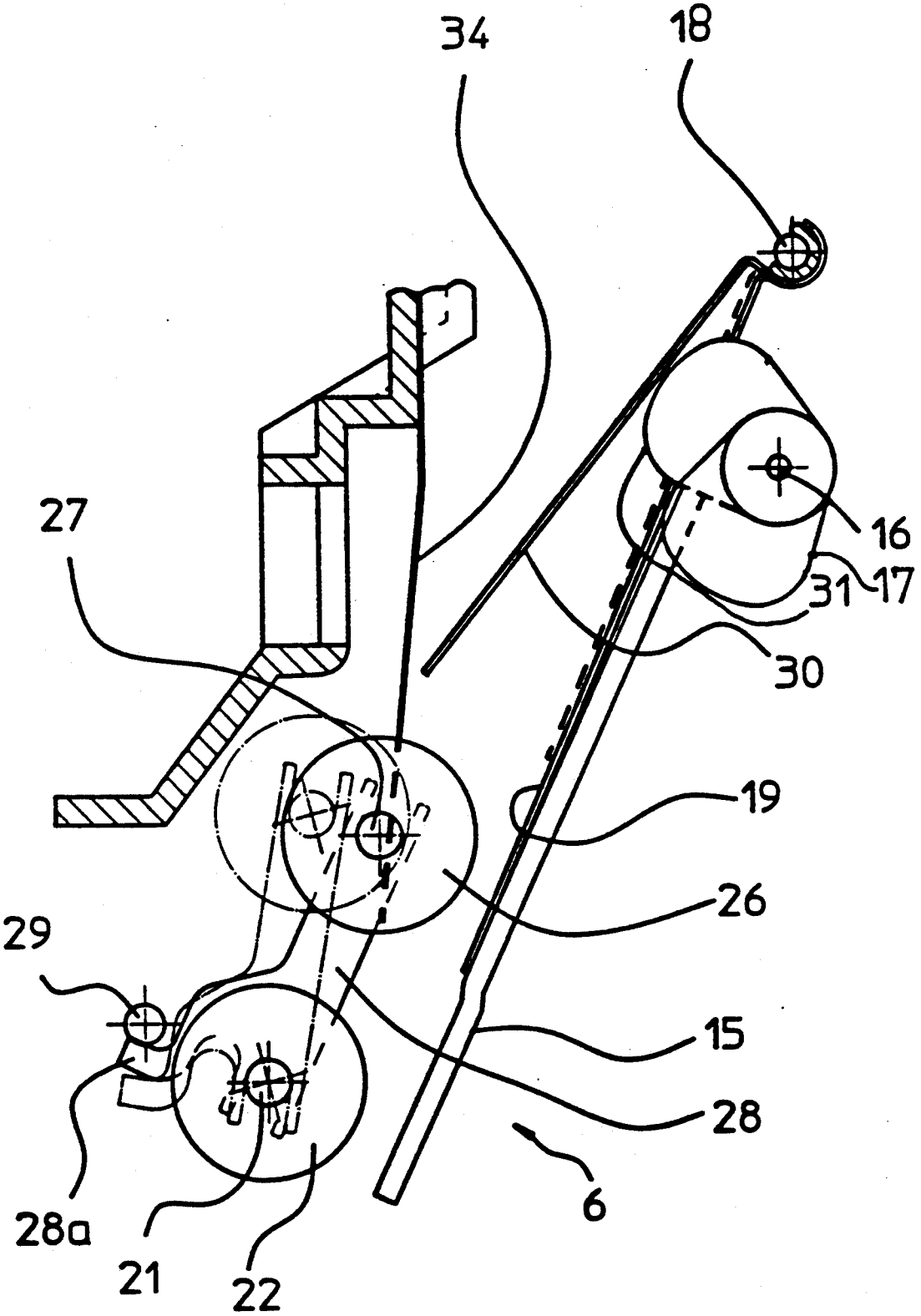
FIG. 2 is a side elevational view of a part of the apparatus according to FIG. 1 showing a medium sheet format setting in a slightly enlarged representation.

If a medium sheet format is to be deposited, e.g., DIN A4 longitudinally, the long guide element 19 contacting depositing surface is lowered and the shorter guide element 30 is pivoted upward by rotating cams 17 and 31 (see FIG. 2). Under the action of gravity, the roller arrangement 26, 27, 28, 32 follows the lowering of the longer guide element 19 until it takes the position shown in FIG. 2 with its arm 28a contacting stop means 29. In this position, the rollers 26, whose surfaces facing the sheet stack are also located beneath the sheet entry plane determined by guide element 30, act as height limiters for the sheet stack as already described with respect to rollers 22 according to FIG. 1. The rollers 22 idling in the position shown in FIG. 2 do not obstruct the depositing and registering operations of the sheets.

On the upper side of the stack of sheets, a known flexible jogger (not illustrated) is arranged which is positioned between rollers 22 and the stop member 14 and driven in the direction of sheet entry, such jogger, by friction, reliably advances the incoming sheets to the stop member 14 and also to a lateral boundary means (not illustrated). As soon as a sheet on top of a stack 23a of sheets has reached stop member 14, the rollers 22 and 26 start slipping on that sheet. Rotating speed, diameter and surface friction coefficient of rollers 22 and 26 are adjusted such that the incoming sheets are advanced without any delay but, after hitting stop member 14, no further advancing action is exerted on the sheet. When the desired number of sheets has entered collecting bin 6, the stapler 20 is activated to staple stack 23. After stapling, stop member 14 is moved aside so that the stapled stack 23 slides down by gravity and with the assistance of the jogger. Then a transport drum 24 engages the stapled stack 23 and advance it to a collecting bin (not illustrated) oriented in a similar position as the upper bin 4 and arranged beneath transport drum 24.

If the longest sheet are to be processed, e.g., DIN A3, control cams 17 and 31 are actuated to pivot guide elements 19 and 30 to an inoperative position (shown in FIG. 3) parallel to the depositing surface 15. After leaving transport rollers 9, 10, the incoming sheet also slide downward by gravity and are registered by the jogger at stop member 14 and a lateral boundary means. Since the long sheets, as already indicated, due to their higher weight and flexibility, show less curl when deposited, no additional measures with respect to a restriction of sheet curling are required. The guiding surface of diverter 8, deflecting the sheet entering in the direction of the arrow "A" to the paper path 13, is arranged in spaced relation to depositing surface 15 of bin 6 such that the leading portion of the long sheets is reliably guided onto the top of already deposited sheet. As indicated in FIG. 1, the stack of sheets 25 already collected does not obstruct the subsequently incoming sheets. When the copier is set to the longest sheet format, according to FIG. 3, in which at the trailing stack portion, as described, no obstruction can occur for the incoming sheets, the rollers 22 and 26 serve merely as guide rollers which limit sheet curling in this area but do not obstruct the registering portion of the sheets.

Figure 3:
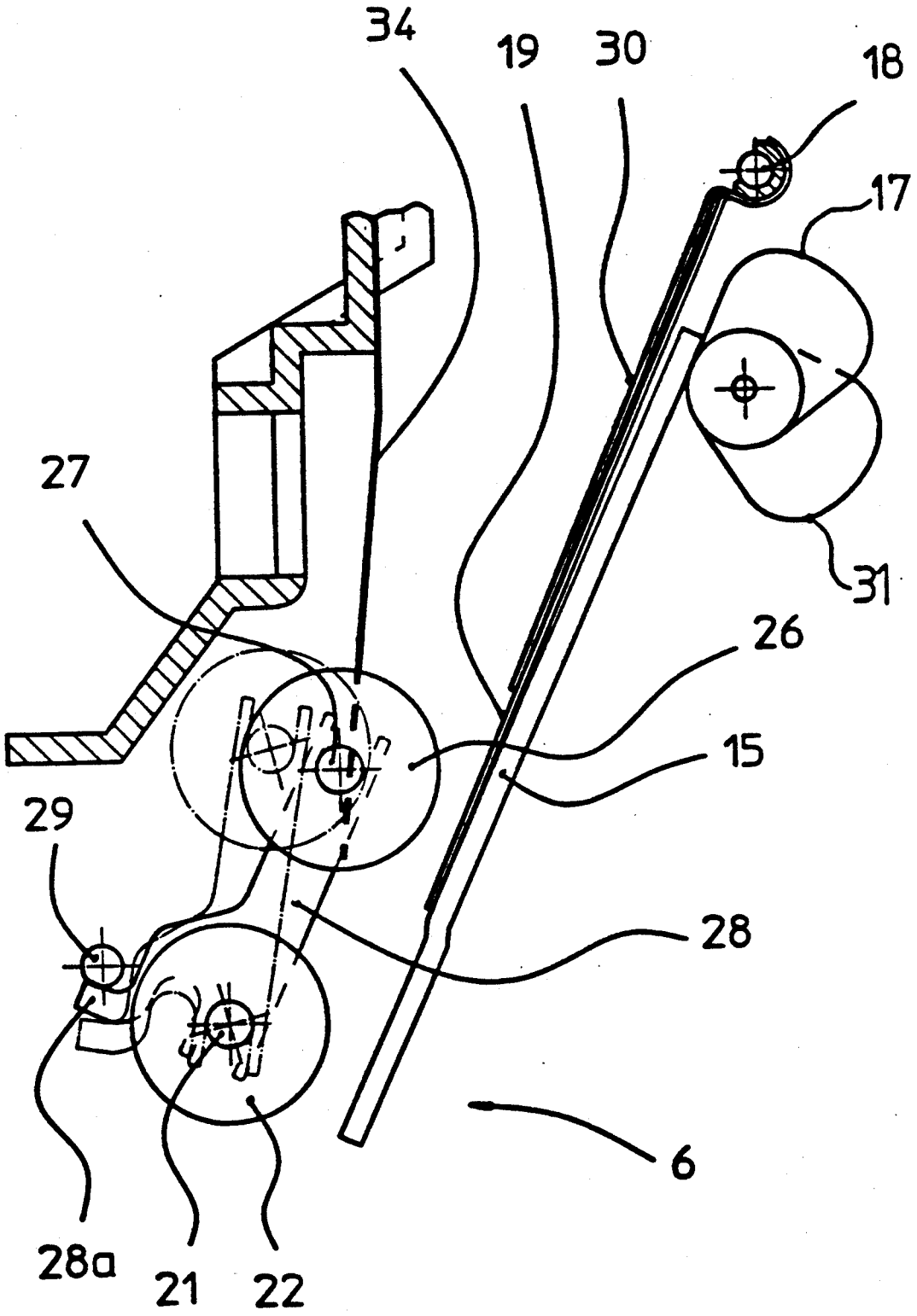
FIG. 3 is a side elevational view of a part of the apparatus according to FIG. 1 showing the longest sheet format setting in a slightly enlarged representation.

As can be inferred from FIGS. 2 and 3, flexible danglers 34 are arranged within collecting bin 6, which prevent incoming sheet from evading upward. The arrangement and design of the rollers 22 and 26, according to the invention, is described in conjunction with a downwardly inclined collecting bin 6, which is arranged at a steep angle and in which, as explained, the degree of sheet curling is particularly high. At a less inclined position or at a horizontal arrangement (not illustrated) of a collecting bin, however, the arrangement of the rollers 22 and 26, according to the invention, can also be used advantageously for limiting the height of the portion of the sheet stack facing the entry area. In such an arrangement of the bin deviating from the preferred embodiment, additional advancing means are required for the sheets, which then are no longer moved by gravity. The described advantageous effect of the roller and the low structure of the bin are thereby not impaired. In addition to the processing of long, medium and short sheets selected for a simplified description of the invention, of course, other sheet formats can also be processed. For example, with the apparatus set to the medium format according to FIG. 2, a format range between DIN A4 (longitudinally) and 8.5"×11" can be processed. This applies analogously to other setting ranges.

The above description and the drawings are confined to features which are essential to the invention. Those features which are disclosed in the description and in the drawing but are not mentioned in the claims also serve for defining the subject matter of the invention, if required.

We claim:

1. In an apparatus for depositing sheets which are individually fed into a bin and collected there in stacked relation, said bin having a depositing surface and a stop means for registering the leading edge of the incoming sheets and at least first and second guide elements arranged opposite said stop means and directing the sheets fed to the bin onto those already deposited, and in which apparatus above the sheet stack to be formed and within the collecting bin at least one stationary roller is arranged which is associated with the trailing portion of the sheet stack facing the guide elements and is driven in sheet entry direction and whose surface facing the sheet stack lies beneath the entry plane of the sheet determined by the guide elements to the extent that it limits the top and trailing portion, respectively, of the sheet stack in a recessed position beneath the sheet entry plane, keeping the feed path open, apparatus for facilitating depositing of sheets in said bin, said facilitating apparatus comprising:

parallel to said stationary roller (22), at least one pivotable roller (26) of identical diameter arranged in spaced relation thereto, said pivotable roller (26)

being positioned upstream of said stationary roller (22), as seen in feeding direction;

said stationary roller (22) being mounted on a shaft (21) and associated with said first guide element (19) and said pivotable roller (26) being associated with said second guide element (30);

said first and second guide elements (19, 30) selectively pivoted from the plane of the depositing surface (15) to a position in which said first and second guide elements extend upward beyond the sheet stack (23, 23*a*) so as to form a ramp;

said pivotable roller (26) being arranged on at least one support (28) which can be pivoted about said shaft (21) of said stationary roller (22) and in the path of movement of said first guide element (19); and said pivotable roller (26) being jointly driven with the stationary roller (22) in the same direction and at the same circumferential speed.

2. Apparatus according to claim 1 wherein an arm (28*a*), in the vicinity of said shaft (21), is integral with said support (28), and stop means (29) limiting the spacing between said pivotable roller (26) and depositing surface (15) is in the pivotal path of said arm (28*a*).

3. Apparatus according to claim 2 wherein said shaft (21) supporting said stationary roller (27) and a shaft supporting said pivotable roller (26) are interconnected by means of a traction drive (33).

4. Apparatus according to claim 1 wherein said collecting bin (6), with it depositing surface (15) and said first and second guide elements (19, 30), is arranged in a downwardly inclined position, as seen in sheet feeding direction.

* * * * *